US006691659B2

(12) United States Patent
Laimböck

(10) Patent No.: US 6,691,659 B2
(45) Date of Patent: Feb. 17, 2004

(54) PUSH ROD FOR USE IN A VALVE ACTUATION DEVICE OF AN INTERNAL COMBUSTION ENGINE

(75) Inventor: Franz Laimböck, Thal (AT)

(73) Assignee: Avl List GmbH, Graz (AT)

( * ) Notice: Subject to any disclaimer, the term of this patent is extended or adjusted under 35 U.S.C. 154(b) by 0 days.

(21) Appl. No.: 10/173,711

(22) Filed: Jun. 19, 2002

(65) Prior Publication Data

US 2003/0024494 A1 Feb. 6, 2003

(30) Foreign Application Priority Data

Jun. 21, 2001 (AT) ..... GM 493/2001 U

(51) Int. Cl.[7] ..... F01L 1/14
(52) U.S. Cl. ..... 123/90.61; 123/90.64
(58) Field of Search ..... 123/90.61, 90.62, 123/90.63, 90.64; 74/579 R; 29/888.2

(56) References Cited

U.S. PATENT DOCUMENTS

| | | | | | |
|---|---|---|---|---|---|
| 1,948,415 | A | * | 2/1934 | Cooper | 123/90.55 |
| 2,019,444 | A | * | 10/1935 | Church | 123/90.56 |
| 2,743,712 | A | * | 5/1956 | Hulsing | 123/90.61 |
| 3,034,488 | A | | 5/1962 | Reiners | 123/276 |
| 3,272,190 | A | * | 9/1966 | Di Matteo et al. | 123/90.61 |
| 4,453,505 | A | * | 6/1984 | Holtzberg et al. | 123/90.61 |
| 4,850,315 | A | | 7/1989 | Mallas | 123/90.61 |
| 5,000,137 | A | * | 3/1991 | Wreinert et al. | 123/90.61 |
| 5,027,763 | A | | 7/1991 | Mallas | 123/90.61 |
| 5,069,173 | A | | 12/1991 | Mallas | 123/90.61 |
| 5,720,246 | A | * | 2/1998 | Griffin et al. | 123/90.61 |
| 6,216,557 | B1 | * | 4/2001 | Ishiuchi et al. | 74/579 R |
| 6,349,615 | B1 | * | 2/2002 | Zimmer et al. | 74/519 |

FOREIGN PATENT DOCUMENTS

| | | |
|---|---|---|
| FR | 1594168 | 7/1970 |
| JP | 59155516 | 9/1984 |

* cited by examiner

*Primary Examiner*—Thomas Denion
*Assistant Examiner*—Ching Chang
(74) *Attorney, Agent, or Firm*—Dykema Gossett PLLC

(57) ABSTRACT

A push rod (1), more specifically for use in a valve actuation device of an internal combustion engine, which is substantially hollow and is provided with a portion (5) of a maximum cross section dimension arranged preferably in the middle between the ends (1*a,* 1*b*) of the push rod (1). In order to provide, in the easiest possible way, a light weight push rod (1) with high buckling resistance, the push rod (1) consists of a first and of a second, substantially hollow rod piece (2, 3), the rod pieces (2, 3) having a maximum cross section dimension in the region of one open front face (2*b,* 3*b*) thereof and being rigidly joined together at their open front faces (2*b,* 3*b*).

17 Claims, 1 Drawing Sheet

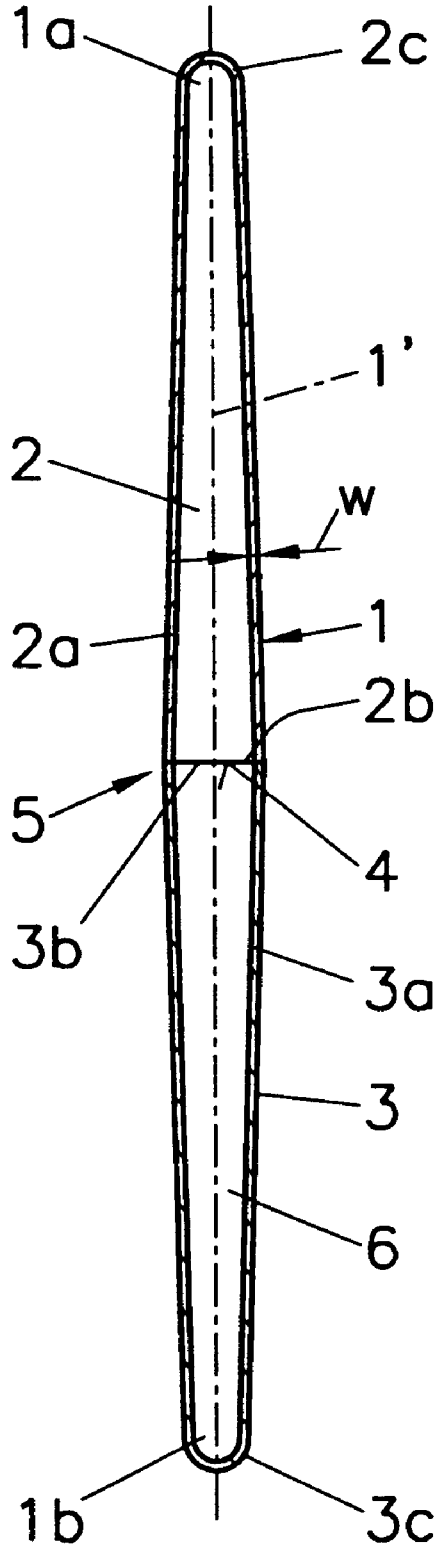
1a
2c
1'
2
w
2a
1
2b
5
4
3b
3a
3
6
1b
3c

PUSH ROD FOR USE IN A VALVE ACTUATION DEVICE OF AN INTERNAL COMBUSTION ENGINE

BACKGROUND OF THE INVENTION

The invention relates to a push rod, more specifically for use in a valve actuation device of an internal combustion engine, which is substantially hollow and is provided with a portion of a maximum cross section dimension arranged preferably in the middle between the ends of the push rod and to a method of manufacturing the same.

It has become known to make push rods for valve actuation devices of internal combustion engine hollow. As compared to solid push rods, they have the advantage of achieving better buckling resistance and strength on the one hand and lighter weight on the other hand.

DESCRIPTION OF PRIOR ART

U.S. Pat. No. 4,850,315 A and U.S. Pat. No. 5, 027,763 A disclose hollow push rods which have a portion of a maximum cross section dimension arranged between the two ends of the push rod. In the portion of a maximum cross section dimension, the outer diameter of the push rod is greater than in the end portions. This double conical shape achieves even better strength and buckling resistance. The push rod is thereby made in one piece and is fabricated from a tube in a cold forming process, the tube being conically formed by means of a tool on either side of the portion of a maximum cross section dimension. As described in U.S. Pat. No. 5,069,173 A, a hollow push rod may be fabricated in the same way, the hollow space thereof having an irregular cross section that departs from a circular line. The starting stock used thereby is a tube with an irregular inner cross section. This way of manufacturing a single piece push rod is quite complicated.

SUMMARY OF THE INVENTION

It is the object of the invention to provide a light weight push rod with high buckling resistance that can be easily manufactured.

This is achieved in accordance with the invention in that the push rod consists of a first and of a second substantially hollow rod piece, the rod pieces having a maximum cross section dimension in the region of one open front face thereof and being rigidly joined together at their open front faces.

Accordingly, the two rod pieces may be made separately, which makes it possible to design the outer shape and the hollow space in a flexible manner. The two rod pieces may hereby be joined by welding, preferably by electron-beam welding, or by gluing. Alternatively, the rod pieces may also be joined by pressing or screwing.

It is advantageous to build the two rod pieces according to the same technique for greatest ease of manufacture.

Particularly high buckling resistance may be achieved when the first rod piece and the second rod piece are substantially shaped like a cone or a cone segment, the respective one of the adjoining front faces of the rod pieces constituting the base of the cone. Portions that are susceptible to bending may thus be realized with a greater diameter. The highest surface pressures occur at the preferably closed ends of the push rod. In order to keep mechanical load on the one side and the weight on the other side as low as possible, it is provided that the wall thickness of the rod piece be greatest in the region of the preferably closed face opposite the open front face.

In order to permit load transfer to be as rigid as possible, for actuating the gas exchange valves of an internal combustion engine for example, there is provided that the push rod has, in axial direction, a spring stiffness of at least 30,000 N/mm in the direction of the push rod's axis.

To further improve the strength of the push rod, there is provided, in a preferred embodiment, that the push rod be filled with a pressurized gas, with nitrogen preferably, the gas pressure within the push rod amounting to at least 50 bar, preferably to at least 100 bar.

After assembly, the push rod may thereby be filled with gas by way of a filling port that is specially provided for this purpose and subsequently closed. Alternatively, the two rod pieces may also be joined together in a pressurized workspace.

BRIEF DESCRIPTION OF THE FIGURE

The invention is explained in closer detail hereinafter with reference to the attached figure.

The figure shows a push rod for a valve actuation device of an internal combustion engine. The axis of the push rod 1 is indicated at 1'. The push rod 1 consists of a first rod piece 2 and of a second rod piece 3. The rod pieces 2, 3, which are provided with rotational symmetry, are hollow, the hollow space, bounded by thin walls 2*a,* 3*a,* being labeled with numeral 6.

DETAILED DESCRIPTION OF THE PREFERRED EMBODIMENT

As indicated in the figure, each of the two rod pieces 2, 3 is shaped like a cone, the rod pieces 2, 3 tapering toward a face 2*c,* 3*c* which is situated opposite an open front face 2*b,* 3*b.* In the exemplary embodiment, the faces 2*c,* 3*c* are closed. The rod pieces have a greater wall thickness w in the region of the faces 2*c,* 3*c* than in the region of the open front face.

In the region of the open front faces 2*b*, 3*b*, the rod pieces 2, 3 are butted and rigidly joined together. The connection is advantageously formed by welding, e.g., by electron-beam welding. The weld seam between the two rod pieces 2, 3 is labeled with numeral 4. Alternatively, the two rod pieces 2, 3 may also be glued together.

In the assembled condition, the push rod 1 is substantially double conical in shape and has a portion 5 of a maximum cross section dimension. The portion of a maximum cross section dimension, which corresponds to the region of the weld seam 4, is advantageously situated approximately in the middle between the two ends 1*a*, 1*b* of the push rod 1.

In order to achieve rigid transfer of load between a camshaft that has not been illustrated herein and a gas exchange valve, the material used for manufacturing the push rod 1 is a material with the highest possible spring stiffness which advantageously is in excess of 30,000 N/mm.

In order to improve bending and buckling resistance of the push rod 1, it is particularly advantageous to have the hollow space 6 within the push rod 1 filled with a gas that is put under high pressure in excess of 100 bar for example. The gas used may be nitrogen for example. Filling may be performed by way of a filling port which is specially provided for this purpose and is subsequently closed after the two rod pieces 2,3 have been permanently assembled. From the point of view of manufacturing, it is however easier to carry out the very assembly procedure in a pressurized workspace. As a result thereof, the push rod 1 may be filled in the same processing step in which the welding or gluing procedure is carried out. This saves further processing steps.

The push rod 1 described permits easy and flexible manufacturing; the cross section of the hollow space 6 can possibly be formed according to the requirements prior to assembling the rod pieces 2, 3. More specifically, the manufacturing method described permits to realize the hollow space 6 of the push rod with varying profile in axial direction.

What is claimed is:

1. A push rod for use in a valve actuation device of an internal combustion engine, said push rod being substantially hollow and having a portion of a maximum cross sectional dimension halfway between ends of the push rod, wherein the push rod consists of first and second substantially hollow rod pieces, said rod pieces having a maximum cross sectional dimension in a region of one open front face thereof and being rigidly joined together at open front faces, and wherein said push rod is filled with a pressurized gas.

2. The push rod according to claim 1, wherein the first and second rod pieces are welded together.

3. The push rod according to claim 1, wherein the first and second rod pieces are welded together by electron-beam welding.

4. The push rod according to claim 1, wherein the first and second rod pieces are glued together.

5. The push rod according to claim 1, wherein the first and second rod pieces are pressed together.

6. The push rod according to claim 1, including screws connecting the first and second rod pieces together.

7. The push rod according to the claim 1 having a substantially double conical shape, wherein the first rod piece and the second rod piece are substantially shaped as a cone or a cone segment, the respective one of the butted front faces of the rod pieces constituting a base of the cone.

8. The push rod according to claim 1, wherein the push rod has, in axial direction, a spring stiffness of at least 30,000 N/mm in the direction of the push rod's axis.

9. The push rod according to claim 1, wherein the pressurized gas is nitrogen.

10. The push rod according to claim 1, wherein said pressurized gas has a gas pressure of at least 50 bar.

11. The push rod according to claim 1, wherein said pressurized gas has a gas pressure of at least 100 bar.

12. The push rod according to claim 1, wherein a wall thickness of the rod piece is greatest in the region of a closed face opposite the open front face.

13. A method of manufacturing a substantially hollow push rod that is provided in a middle, between ends thereof, with a portion of a maximum cross section diameter, comprising the steps of rigidly joining together a first and second rod piece, which are both substantially hollow, in the region of open front faces thereof, and filling the joined first and second rod pieces with a pressurized gas to a pressure of at least 50 bar.

14. The method according to claim 13, including joining the first and second rod pieces by electron-beam welding.

15. The method according to claim 13, including joining the first and second rod pieces by gluing, pressing or screwing.

16. The method according to claim 13, including filling the push rod with a pressurized gas to a pressure of at least 100 bar.

17. The method according to claim 13, including joining the first and second rod pieces in a pressurized workspace.

* * * * *